US007654109B2

(12) United States Patent
Vaisman et al.

(10) Patent No.: US 7,654,109 B2
(45) Date of Patent: Feb. 2, 2010

(54) REFRIGERATING SYSTEM WITH ECONOMIZING CYCLE

(75) Inventors: Igor B. Vaisman, West Hartford, CT (US); Mikhail B. Gorbounov, South Windsor, CT (US); Jean-Francois Heitz, Miribel (FR); Kais Djemili, Montluel (FR)

(73) Assignee: Carrier Corporation, Farmington, CT (US)

( * ) Notice: Subject to any disclaimer, the term of this patent is extended or adjusted under 35 U.S.C. 154(b) by 213 days.

(21) Appl. No.: 11/793,961

(22) PCT Filed: Sep. 27, 2005

(86) PCT No.: PCT/US2005/034735

§ 371 (c)(1),
(2), (4) Date: Jun. 25, 2007

(87) PCT Pub. No.: WO2006/083329

PCT Pub. Date: Aug. 10, 2006

(65) Prior Publication Data

US 2008/0092573 A1 Apr. 24, 2008

Related U.S. Application Data

(60) Provisional application No. 60/649,423, filed on Feb. 2, 2005.

(51) Int. Cl.
*F25B 41/00* (2006.01)
*F25B 15/00* (2006.01)
*F25B 5/00* (2006.01)

(52) U.S. Cl. ..... 62/513; 62/498; 62/117; 62/196.3

(58) Field of Classification Search ..... 62/115, 62/117, 175, 196.4, 222, 238.6, 473, 498, 62/507, 509, 513; 165/99, 104, 110, 139, 165/144, 154, 173
See application file for complete search history.

(56) References Cited

U.S. PATENT DOCUMENTS 4,850,197 A * 7/1989 Taylor et al. ..... 62/81
5,174,123 A * 12/1992 Erickson ..... 62/113
6,385,981 B1 * 5/2002 Vaisman ..... 62/196.3
6,694,750 B1 * 2/2004 Lifson et al. ..... 62/113

* cited by examiner

*Primary Examiner*—Frantz F Jules
*Assistant Examiner*—Emmanuel Duke
(74) *Attorney, Agent, or Firm*—Marjama Muldoon Blasiak & Sullivan LLP

(57) ABSTRACT

The invention relates to refrigerating systems, primarily, to refrigerating systems employing compressors with economizing inlets and multi-pass condensers. In accordance with the invention a refrigerating system with economizing cycle employs a compressor unit with an economizer inlet and a condenser unit having a first condensation stage, a second condensation stage, and means to remove liquid refrigerant portion between the condensation stages. An intermediate liquid outlet from the first condensation stage feeds a circuit with the evaporator and a liquid outlet from the second condensation stage feeds a circuit with the economizer inlet. The invention provides a high efficiency refrigerating system incorporating of advantages of cost-effectiveness provision of liquid sub-cooling or/and liquid temperature inherent for refrigerating systems with economizing cycle and cost-effectiveness advantages of two-stage condensation condensers.

55 Claims, 11 Drawing Sheets

REFRIGERATING SYSTEM WITH ECONOMIZING CYCLE

CROSS REFERENCE TO RELATED APPLICATION

This application claims priority to and the benefit of U.S. Provisional Patent Application Ser. No. 60/649,423, filed Feb. 2, 2005, and entitled REFRIGERATING SYSTEM WITH ECONOMIZING CYCLE, which application is incorporated herein by this reference.

TECHNICAL FIELD

The invention relates generally to refrigerating systems and, more particularly, to refrigerating systems employing compressors with economizing inlets and multi-pass condensers.

BACKGROUND OF THE INVENTION

Liquid refrigerant condensed inside refrigerant channels occupies an insignificant part of the entire internal condenser volume, but it sticks to the condenser walls and covers up significant part of its heat transfer area. As a result, vapor refrigerant, which occupies a significant part of the entire internal volume, does not contact the condenser walls and overall heat transfer ratio is substantially reduced.

A number of patents (U.S. Pat. No. 5,988,267 and U.S. Pat. No. 5,762,566) addressed this by splitting condensers in a number of passes and removing of a condensed portion from refrigerant stream after each pass. This reduces mass flow rate in each following pass, increases the heat transfer area interfacing with the condensing vapor, improves overall heat transfer ratio, reduces temperature difference required for the condenser duty, and reduces discharge pressure. As a result, performance characteristics are enhanced if heat transfer area parity is provided or the cost is reduced if parity of the performance characteristics is provided.

Such condensers may provide substantial sub-cooling in the last condensation pass only. When liquid refrigerant streams outgoing from all condenser passes are mixed, liquid sub-cooling of the entire refrigerant stream is reduced. If the liquid line is too long and/or pressure drop in the liquid line is substantially high, then at certain operating conditions there is potential risk of evaporation of liquid refrigerant at the expansion device inlet. Evaporation of liquid refrigerant at the expansion device inlet results in unstable operation of the entire refrigerating system and degradation of performance characteristics.

In U.S. Pat. No. 5,752,566 a condenser has a plurality of headers having baffles and/or phase separators positioned therein. The refrigerant strikes a sidewall of one of the headers and respective phases are separated by gravity. Additionally, phase separators may be used to selectively route the vapor and liquid phases to specific locations in the condenser. This patent implies that refrigerant after the condenser is directed to a liquid refrigerant receiver and then to a sub-cooling section. The sub-cooling section handles the entire refrigerant mass flow rate and carries thermal load associated with the entire refrigerant mass flow rate. Since the temperature difference driving the heat transfer process is significantly lowered, the sub-cooling section may be classified as an inefficient heat exchanging device in comparison with the condensation section.

U.S. Pat. No. 6,385,981 B1 relates to refrigerating systems accommodating the economizing cycle. The economizing cycle utilizes an economizing heat exchanger providing thermal contact between liquid refrigerant in the liquid line and evaporating refrigerant at a pressure lower than the discharge pressure and higher than the suction pressure. Such a heat exchanger has substantially high overall heat transfer ratio between liquid and evaporating refrigerant streams and, therefore, provides very efficient sub-cooling duty. This significantly reduces initial cost of means providing the adequate sub-cooling. However, refrigerating systems utilizing the economizing cycle require increased refrigerant mass flow rate through the condenser and, therefore, demand higher condenser capacities and sizes. Additionally, they elevate potential risk of evaporation of liquid refrigerant at the expansion device inlet.

U.S. Pat. No. 5,692,389 relates to refrigerating systems accommodating the economizing cycle with a flash tank. The flash tank has vapor and liquid outlets. The liquid outlet feeds a circuit with an evaporator. The vapor outlet feeds a circuit with the economizer inlet at a pressure lower than the discharge pressure and higher than the suction pressure. The flash tank provides liquid refrigerant at the liquid outlet at the same temperature as an economizing heat exchanger does in the above-mentioned example. The refrigerating systems utilizing an economizing cycle with a flash tank require increased refrigerant mass flow rate through the condenser, demand higher refrigerant mass flow rate through the condenser, higher condenser capacities and sizes than refrigerating systems utilizing an economizing cycle with an economizing heat exchanger.

DISCLOSURE OF THE INVENTION

The purpose of the invention is to incorporate advantages of cost-effectiveness provision of liquid sub-cooling or/and liquid temperature by refrigerating systems with economizing cycle and cost-effectiveness advantages of multi-pass condensers. This allows creating a high efficiency refrigerating system.

In accordance with the invention a refrigerating system with economizing cycle comprises a main refrigerant loop and an economizing refrigerant circuit. The main refrigerant loop consists of an evaporator, a suction line, a compressor unit with an economizer inlet, a condenser unit, a main liquid line, and the economizing refrigerant circuit. The liquid line includes a liquid receiver, an economizing heat exchanger, and a main expansion device. The economizing refrigerant circuit consists of an economizing expansion device and the economizing heat exchanger. The economizing heat exchanger has a high-pressure side and a low-pressure side. The high-pressure side is associated with the main refrigerant loop and the low-pressure side is associated with the economizing refrigerant circuit. The condenser unit comprises a vapor inlet, an intermediate liquid outlet, and a liquid outlet. A first condensation stage is associated with part of the refrigerant channels and with the intermediate liquid outlet. A second condensation stage is associated with other part of the refrigerant channels and with the liquid outlet. The main liquid line carries liquid refrigerant outgoing from the first condensation stage and feeds a circuit with the evaporator. The economizing liquid line carries liquid refrigerant outgoing from the second condensation stage and feeds a circuit with the economizer inlet. The first condensation stage is sized to provide liquid mass flow rate after the first condensation stage equal to required mass flow rate through the evaporator. The second condensation stage is sized to provide liquid mass flow rate after the second condensation stage equal to mass flow rate through the economizing inlet of the compressor.

Another aspect of the current invention is a refrigerating system with economizing cycle and with a flash tank. The flash tank comprises an inlet and an outlet associated with the main liquid line, and an inlet and an outlet associated with the economizing refrigerant circuit.

The liquid line comprises an additional expansion device, the flash tank, and a main expansion device. The economizing refrigerant circuit includes an economizing expansion device, and the flash tank.

The flash tank may have a float indicating level of liquid refrigerant in the flash tank. Based on a position of the float a controller reduces an opening of the additional expansion device when level of liquid refrigerant in the flash tank is high and increases the opening of the additional expansion device when level of liquid refrigerant in the flash tank is low.

There are different options associated with the above-mentioned major aspects of the inventions.

In accordance with the invention, both aspects may employ a one-stage compressor or a multi-stage compressor with the economizing inlet.

One liquid-to-suction heat exchanger provides thermal contact between liquid refrigerant stream in the main liquid line and superheated refrigerant stream leaving the evaporator. Another liquid-to-suction heat exchanger provides thermal contact between liquid refrigerant stream in the economizing refrigerant circuit and superheated refrigerant stream leaving the evaporator. There is an option to have either liquid-to-suction heat exchanger or both of them. If both liquid-to-suction heat exchangers are applied, the second liquid-to-suction heat exchanger provides thermal contact between liquid refrigerant stream in the economizing refrigerant circuit and superheated refrigerant stream leaving the first liquid-to-suction heat exchanger.

An expansion valve with a sensing bulb located at outlet from the evaporator is used as the main expansion device. An expansion valve with a sensing bulb located at outlet from the low-pressure side of the economizing heat exchanger is used as the economizing expansion device.

A main solenoid valve is installed on the main liquid line. An economizing solenoid valve is installed on the economizing liquid line. Use of the both solenoid valves is an option as well.

A main filter-drier is installed on the main liquid line and an economizing filter-drier is installed on the economizing liquid line.

The condenser unit has a two-stage condensation coil with a vapor inlet, an inlet header, an outlet header, plurality of refrigerant channels extended between the inlet and outlet headers and sealed inside the inlet and outlet headers, an intermediate liquid outlet, a liquid outlet, and means to route refrigerant flow from the vapor inlet to the intermediate liquid and liquid outlets. A first condensation stage associated with one part of the refrigerant channels and with the intermediate liquid outlet. A second condensation stage is associated with other part of the refrigerant channels and with the liquid outlet. Also, the coil has means to remove a condensed liquid portion after the first condensation stage. The means to route refrigerant flow from the vapor inlet to the intermediate liquid and liquid outlets are baffles, phase separators, and a collector inside the inlet and outlet headers. The means to remove condensed liquid portion after the first condensation stage are baffles, phase separators, and a collector inside the inlet and outlet headers.

When plurality of coils is applied the vapor inlets of each coil are connected to the vapor inlet of the condenser unit, intermediate liquid outlets of each coil are connected to the intermediate liquid outlet of the condenser unit, and liquid outlets of each coil are connected to the liquid outlet of the condenser unit.

The portion of refrigerant channels related to the first condensation stage and the portion of refrigerant channels related to the second condensation stage are usually oriented horizontally and condensing refrigerant flow is routed from top to bottom, from bottom to top, or a portion of condensing refrigerant flow is routed downwards and another portion is routed upwards.

The portion of refrigerant channels related to the first condensation stage and the portion of refrigerant channels related to the second condensation stage are oriented vertically. In this case the inlet header is located at the top and the outlet header is located at the bottom or the inlet header is located at the bottom and the outlet header is located at the top.

In some applications at least one whole coil in the first condensation stage and at least one whole coil in the second condensation stage are applied. Also, it is possible to have in each condensation stage a combination of at least one whole coil and a portion of refrigerant channels associated with at least one two-stage condensation coil.

DETAILED DESCRIPTION OF THE INVENTION

Figure 1:
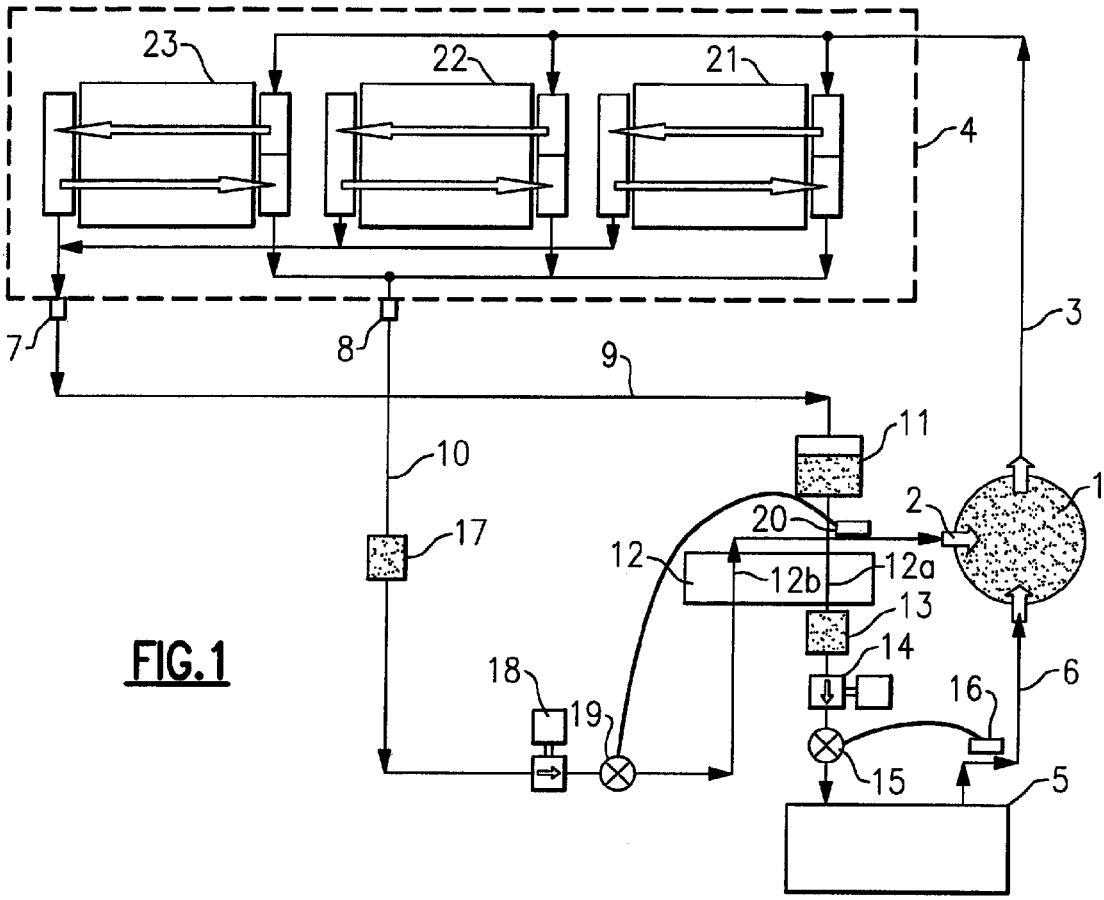
FIG. 1 is a schematic illustration of a refrigerating system with an economizing cycle utilizing an economizing heat exchanger and two-stage condensation condenser coils in accordance with one aspect of the invention.

FIG. 1 shows a refrigerating system having a set of basic components, which are: a compressor 1 with an economizing inlet 2, a discharge line 3, a condenser unit 4, an evaporator 5, and a suction line 6.

The condenser unit 4 has two condensation stages, an intermediate liquid outlet 7 associated with a first condensation stage and a liquid outlet 8 associated with a second condensation stage. The refrigerating system has two liquid lines: a main liquid line 9 and an economizing liquid line 10 outgoing from the condensation stage outlets 7 and 8 respectively.

A liquid receiver 11, a high-pressure side 12*a* of an economizing heat exchanger 12, a filter-drier 13, a solenoid valve 14, an expansion device 15 are installed on the liquid line 9. If the expansion device 15 is a thermal expansion valve, then a sensing bulb 16 is installed at outlet from the evaporator 5 and a pressure equalization line is connected to the outlet from the evaporator 5. If the expansion device 15 has an ability to stop liquid refrigerant in the main liquid line 9 during off-cycle or migration of refrigerant from the liquid line 9 to the suction line 6 is not an issue, then the solenoid valve 14 is not needed.

A filter-drier 17, a solenoid valve 18, an expansion device 17, a low-pressure side 12*b* of the economizing heat exchanger 12, and the economizing inlet 2 of the compressor 1 are installed on the economizing liquid line 10. If the expansion device 19 is a thermal expansion valve, then a sensing bulb 20 is installed on the low-pressure side 12*b* at outlet from the economizing heat exchanger 12 and a pressure equalization line is connected to outlet from the economizing heat exchanger 12 on the low-pressure side 12*b*. If the expansion device 19 has an ability to stop liquid refrigerant in the liquid line 10 during off-cycle or migration of refrigerant from the liquid line 10 to the economizing inlet 2 is not an issue, then the solenoid valve 18 is not needed.

It is important to underline that the refrigerating system with economizing cycle may be split in two major parts: a main refrigerant loop and an economizing refrigerant circuit. The main refrigerant loop includes the compressor 1, the discharge line 3, the condenser unit 4, the intermediate liquid outlet 7, the liquid line 9 and related components, the evaporator 5, and the suction line 6. The economizing refrigerant circuit includes the liquid line 10 outgoing from the liquid outlet 8 and components related to the liquid line 10.

The first condensation stage, is sized to provide liquid mass flow rate after the first condensation stage equal to required mass flow rate through the evaporator 5. The second condensation stage is sized to provide liquid mass flow rate after the second condensation stage equal to mass flow rate through the economizing inlet 2 of the compressor 1. The mass flow through the evaporator 5 is a derivative of the evaporator capacity. The mass flow through the economizing inlet 2 balances the economizing heat exchanger 12 to obtain the required sub-cooling of the liquid flow in the high-pressure side 12*a*.

Liquid films in condensers cover up part of the internal surface of the refrigerant channels. Also, the other side of liquid films contact vapor being condensed. Liquid & vapor interface has saturated temperature and zero-sub-cooling. Liquid & refrigerant channels interface is colder and has non-zero sub-cooling. The closer to the condenser exit the liquid film is, the larger the liquid fraction is condensed and the higher the sub-cooling degree is. Therefore, the first condensation stage does not provide substantial sub-cooling. The second condensation stage may provide substantial sub-cooling.

The staged condensation with removal of liquid refrigerant fraction or removal of a portion of this fraction between the stages reduces the amount of liquid refrigerant in the condenser unit. Having less liquid in the condenser unit, the heat transfer area contacting the vapor being condensed is increased, overall heat transfer ratio is improved, temperature difference driving the condensation process is reduced, and the discharge pressure is reduced. As a result performance characteristics are enhanced if the heat transfer area parity is provided, or the cost is reduced if parity of the performance characteristics is provided.

Figure 2:
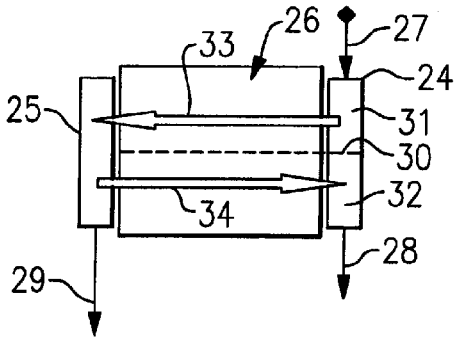
FIG. 2 is a schematic illustration of a two-stage condensation coil with one pass in each condensation stage.

In FIG. 1 the condenser unit has three two-stage condensation condenser coils 21, 22, and 23. However, it is sufficient to have one coil with two condensation stages. Such a coil is shown on FIG. 2. The coil has an inlet header 24, an outlet header 25, and a plurality of refrigerant channels 26 extending between the inlet and outlet headers 24 and 25. The refrigerant channels 26 are sealed within the inlet and outlet headers 24 and 25. The external surface of the channels is thermally exposed to a cooling fluid. The inlet header 24 has a vapor inlet 27 and an intermediate liquid outlet 28 associated with the main liquid line 9. The outlet header 25 has a liquid outlet 29. The inlet header 24 contains a phase separator 30 for splitting said inlet header into an upper chamber 31 and a lower chamber 32. The upper chamber 31 is associated with the vapor inlet 24 and with the first condensation stage 33. The lower chamber 32 is associated with the intermediate liquid outlet 28 and with the second condensation stage 34. As refrigerant fills the upper chamber 32, it contacts phase separator 30, which selectively routes liquid-rich phase downwardly into the lower chamber 32. The vapor-rich phase moves through refrigerant channels associated with the first condensation stage 33 to the outlet header 25.

Figure 3:
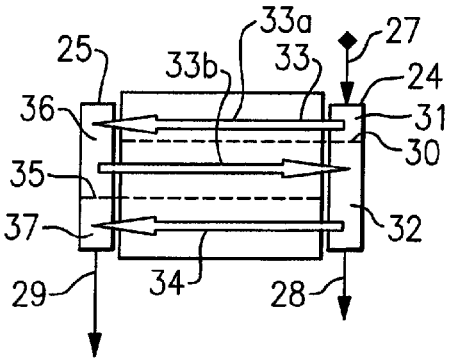
FIG. 3 is a schematic illustration of a two-stage condensation coil with two passes in the first condensation stage and one pass in the second condensation stage.

Each condensation stage may be circuited to have a number of passes. The coil in FIG. 2 has one pass in each condensation stage. FIG. 3 presents a coil having two passes 33*a* and 33*b* in a first condensation stage 33 and one pass in a second condensation stage 34. An inlet header 24 has a phase separator 30. The phase separator 30 splits the inlet header 24 into an upper chamber 31 associated with the vapor inlet 27 and a lower chamber 32 associated with an intermediate outlet 28. An outlet header 25 has a phase separator 35, which splits the outlet header into an upper chamber 36 and a lower chamber 37. The upper chamber 36 is associated with the first condensation stage 33. The lower chamber 37 is associated with the second condensation stage 34 and a liquid outlet 29.

Figure 4:
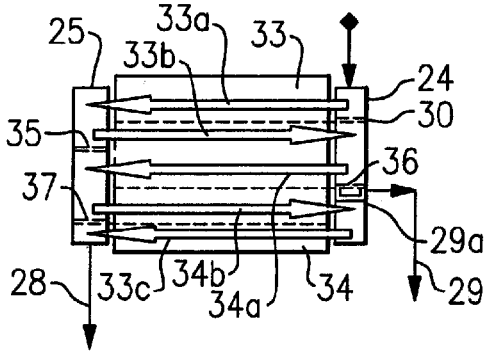
FIG. 4 is a schematic illustration of a two-stage condensation coil with two passes in the first condensation stage and three passes in the second condensation stage.

It is possible to have a coil with multiple passes in each condensation stage. For example, FIG. 4 represents two (i.e. 33*a* and 33*b*) passes in a first condensation stage 33 and three passes (i.e. 34*a*, 34*b*, and 34*c*) in a second condensation stage 34. Phase separators 30 and 36 in an inlet header 24 and phase separators 35 and 37 in an outlet header 25 are employed. Also, a collector 29*a* is employed near a liquid outlet 29.

Figure 5:
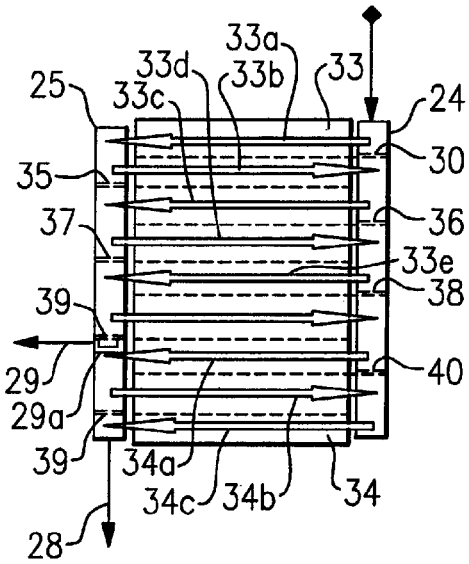
FIG. 5 is a schematic illustration of a two-stage condensation coil with five passes in the first condensation stage and four passes in the second.

FIG. 5 represents five (i.e. 33*a*, 33*b*, 33*c*, 33*d*, and 33*e*) passes in a first condensation stage 33 and three passes (i.e. 34*a*, 34*b*, and 34*c*) in a second condensation stage 34. Phase separators 30, 36, 38, and 40 in an inlet header 24 and phase separators 35, 37, 39, and 41 in an outlet header 25 are employed. Also, a collector 29*a* is employed near a liquid outlet 29.

In FIG. 4 the intermediate liquid outlet 28 is located in the outlet header 25 and the liquid outlet 29 is located in the inlet header 24, but in FIG. 5 the intermediate liquid outlet 28 and the liquid outlet 29 are located in the outlet header 25. Also, there are possible constructions when the intermediate liquid outlet 28 is located in the inlet header 24 and the liquid outlet 29 is located in the outlet header 25 and constructions when the intermediate liquid outlet 28 and the liquid outlet 29 are located in the inlet header 24.

Usually, the number of passes in the first condensation stage is larger than in the second condensation stage. However, in the current invention, the numbers of passes in each condensation stage and performance characteristics of the compressor 1 depend on each other.

In the condenser coils shown in FIG. 2, FIG. 3, FIG. 4, and FIG. 5 the refrigerant channels extending between the inlet header 24 and outlet header 25, are oriented horizontally and the condensing refrigerant flow is routed from top to bottom. There is an option to use the condenser coils shown in FIG. 2, FIG. 3, FIG. 4, and FIG. 5 in a reverse direction, wherein the vapor inlet is 29 instead of 27, the vapor outlet is 27 instead of 29 and the intermediate liquid outlet 28 remains the same. In this case the condensing refrigerant flow is routed from bottom to top.

Figure 6:
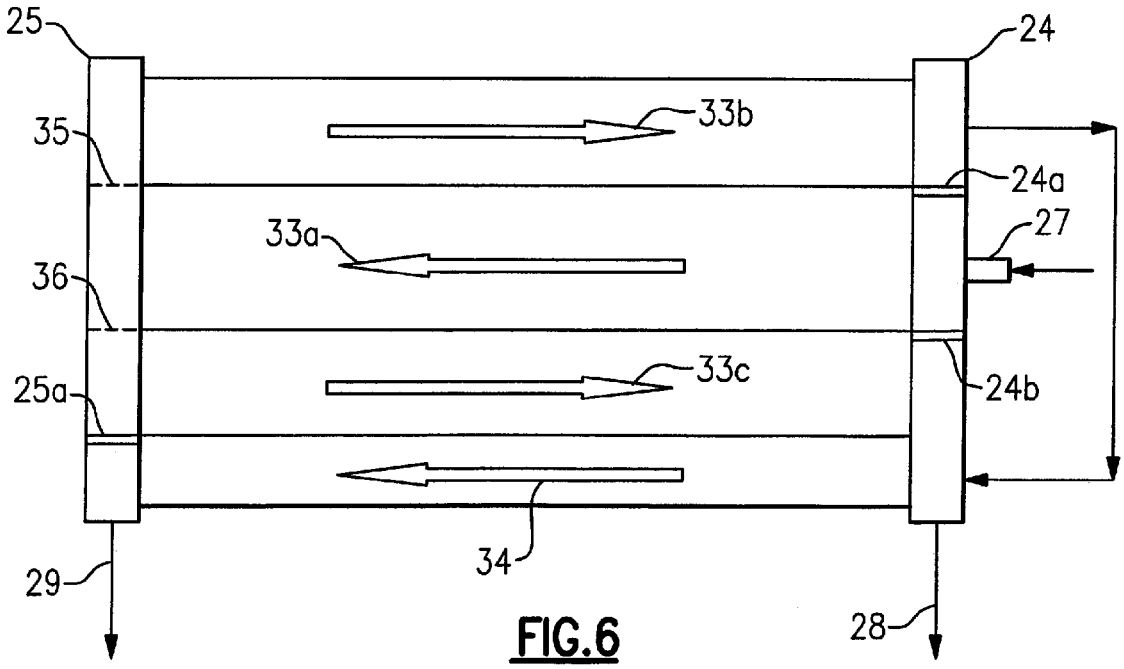
FIG. 6 is a schematic illustration of a two-stage condensation coil with condensing refrigerant flow routed from middle to top and from middle to bottom.

Configurations as mentioned in U.S. Pat. No. 5,988,267 and in U.S. Pat. No. 5,762,566, are possible as well. FIG. 6 demonstrates a two-stage condensation coil with condensing refrigerant flow routed from middle to top and from middle to bottom. The coil has an inlet header 24, an outlet header 25, and plurality of refrigerant channels 26 extending between the inlet and outlet headers 24 and 25. The refrigerant channels 26 are sealed within the inlet and outlet headers 24 and 25. The external surface of the channels is thermally exposed to a cooling fluid. The inlet header 24 has a vapor inlet 27 and an intermediate liquid outlet 28 associated with the main liquid line 9. The outlet header 25 has a liquid outlet 29. The inlet header 24 contains baffles 24*a* and 24*b* to route a pass 33*a* into the outlet header 25. The inlet header 24 has the following chambers: a chamber between the baffles 24*a* and 24*b* associated with the pass 33*a* and the vapor inlet 27; a chamber between the baffle 24*a* and top portion of the inlet header 24 associated with a pass 33*b*; a chamber between the baffle 24*b* and bottom portion of the inlet header 24 associated with a pass 33*c*, a pass 34, and the intermediate liquid outlet 28. The last two chambers of the inlet header 24 are in direct communication to allow liquid refrigerant to flow downwardly. The outlet header 25 has phase separator 35 and 36 and a baffle 25*a* splitting the outlet header 25 into four chambers: a chamber between the phase separators 35 and 36 associated with the pass 33*a*; a chamber between the phase separator 35 and top portion of the outlet header 25 associated with the pass 33*b*; a chamber between the phase separators 36 associated with the pass 33*c*; a chamber between the baffle 25*a* and bottom portion of the outlet header 25 associated with a pass 34 and the liquid outlet 29. A first condensation stage includes the passes 33*a*, 33*b*, and 33*c*. A second condensation stage contains the pass 34.

Figure 7:
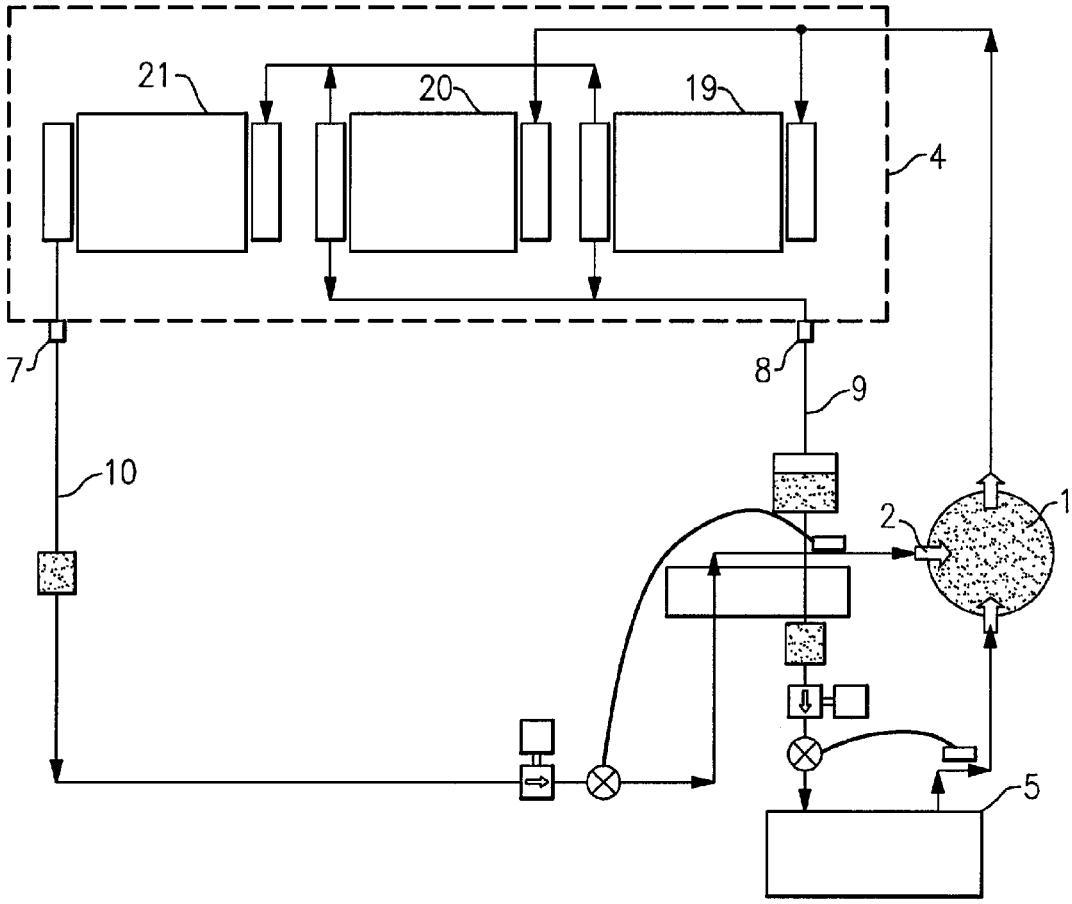
FIG. 7 is a schematic illustration of a refrigerating system with economizing cycle utilizing an economizing heat exchanger and whole condenser coils.

Large chilling systems may have a number of whole condenser coils in a first condensation stage and another number of condenser coils in a second condensation stage. In FIG. 7 the first condensation stage which includes coils 19 and 20, is connected to a liquid line 9 through an intermediate liquid outlet 8, and feeds a circuit with an evaporator 5. The second condensation stage has a coil 21, is connected to a liquid line 10 through a liquid outlet 7, and feeds a circuit with an economizer inlet 2 of a compressor 1.

Figure 8:
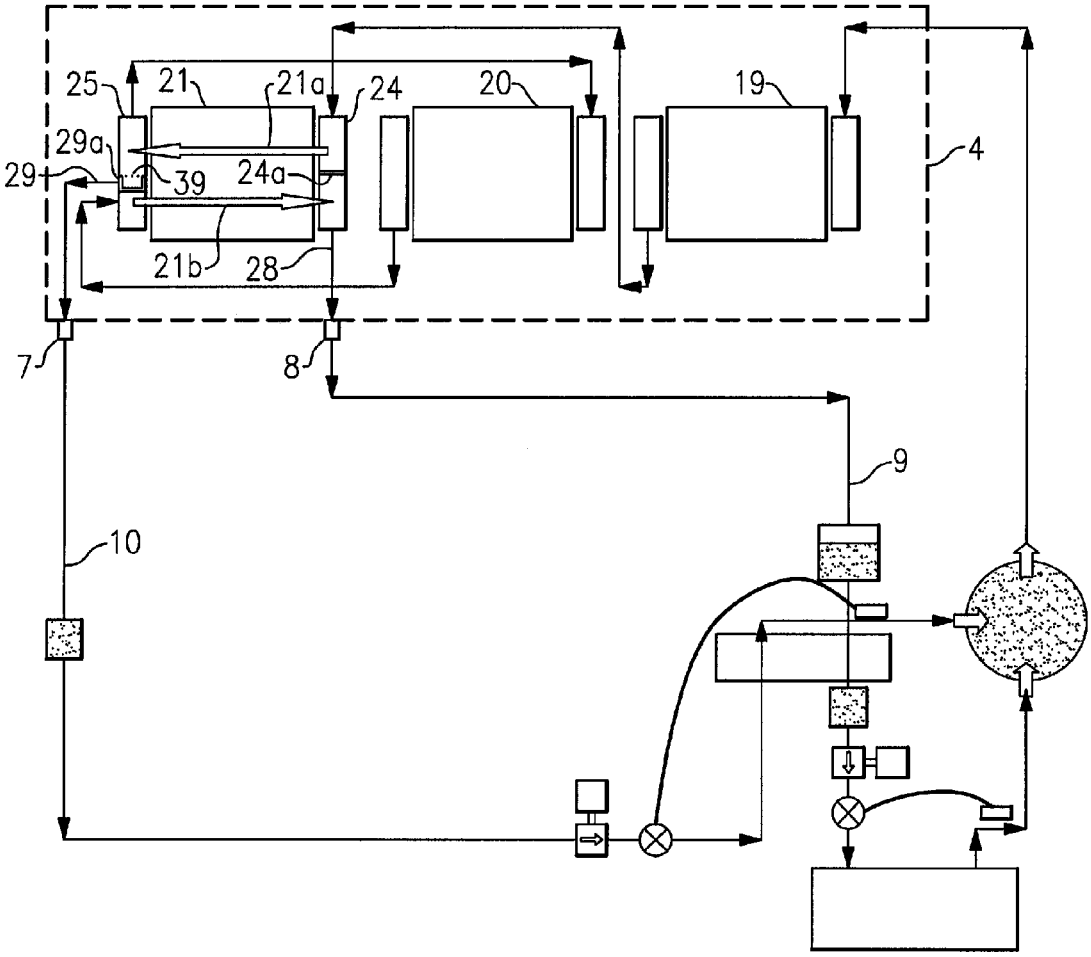
FIG. 8 is a schematic illustration of a refrigerating system with economizing cycle utilizing an economizing heat exchanger and a combination of whole condenser coils and two-stage condensation condenser coils.

Also, there is an option to have a combination of a number of whole coils and another number of staged coils in each condensation stage. In FIG. 8*a* first condensation stage includes a coil 19 and a portion 21*a* of a coil 21 and is connected to a liquid line 9 through an intermediate liquid outlet 8. A second condensation stage has a coil 20 and a portion 21*b* of a coil 21 and is connected to a liquid line 10 through a liquid outlet 7.

The current invention may employ any other condenser coils and units as long as they have two-condensation stages, a vapor inlet, an intermediate liquid outlet, and a liquid outlet.

It was mentioned that the first condensation stage is sized to provide liquid mass flow rate after the first condensation stage equal to the required mass flow rate through the evaporator 5; the second condensation stage is sized to provide liquid mass flow rate after the second condensation stage equal to the mass flow rate through the economizing inlet 2 of the compressor 1. At some operation conditions the sized condensation stages may not provide the targeted equality of mass flow rates. A refrigerating system shown in FIG. 9 has a compensation liquid line 10*a* connecting the liquid line 9 outgoing from the intermediate liquid outlet 7 and the liquid line 10 outgoing from the liquid outlet 8. One end of the compensation liquid line 10*a* tees the liquid line 10 between the filter-drier 17 and the solenoid valve 18. Another end of the liquid lines tees the liquid line 9 between the filter-drier 13 and the solenoid valve 14 to avoid any refrigerant from flowing through the filtering and drying process twice. If inequality takes place at some operating conditions, the compensation liquid line 10*a* allows redistribution of refrigerant flow between the liquid lines 9 and 10 to satisfy the requirements of the economizing inlet 2 and the requirements of the evaporator 5.

The compensation line 10*a* may have a valve 10*b* to disable and to enable mass exchange between the liquid lines 9 and 10.

Figure 10:
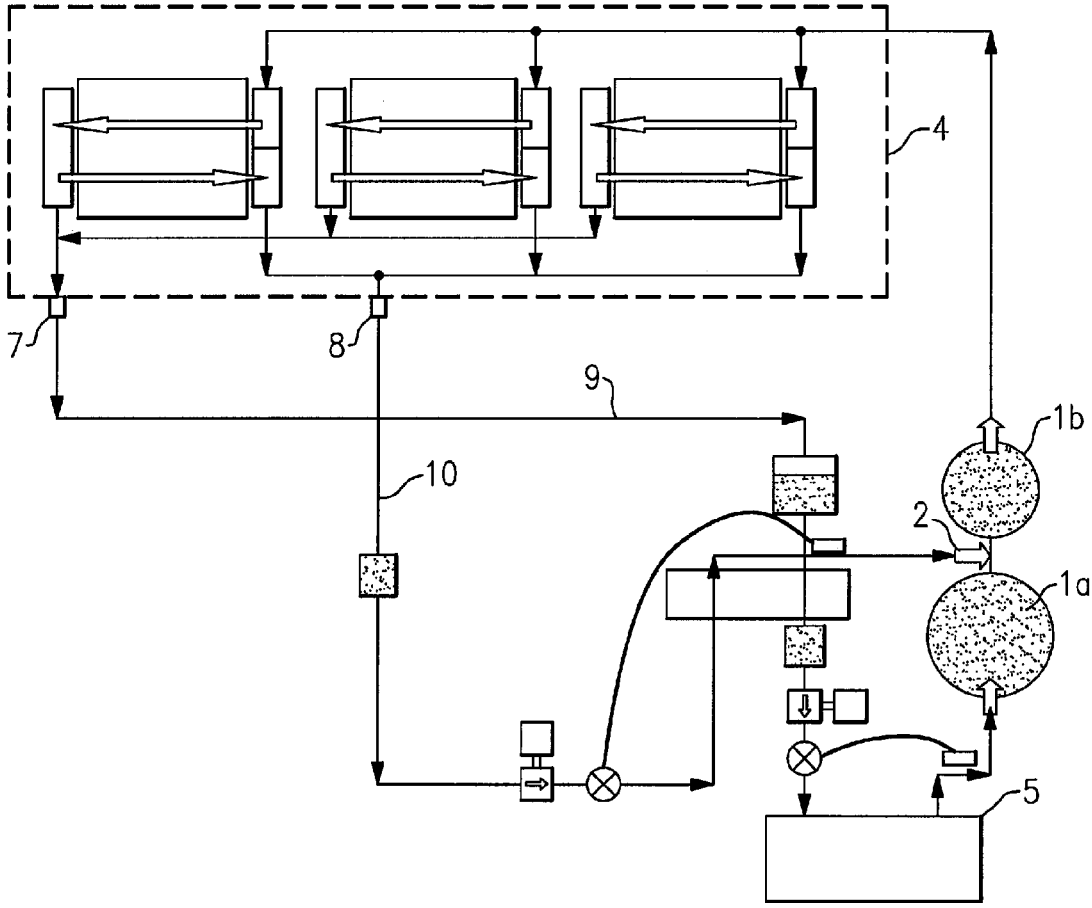
FIG. 10 is a schematic illustration of a refrigerating system with economizing cycle utilizing a two-stage compressor, an economizing heat exchanger and two-stage condensation condenser coils.

A refrigerating system shown in FIG. 10 employs a two-stage compressor. The two-stage compressor consists of a first compression stage 1*a*, a second compression stage 1*b*, and an economizer inlet 2 between these compression stages. The mass flow rate pumped by the first compression stage must satisfy the mass flow requirements for a circuit with an evaporator 5. The mass flow rate pumped by a second compression stage must satisfy the mass flow requirements for a circuit with an economizer inlet 2 and for the circuit with the evaporator 5.

The system may employ a multi-stage compressor, and a number of the compression stages may serve as the first compression stage 1*a* and the rest of the stages may serve as the second compression stage 1*b*.

Figure 11:
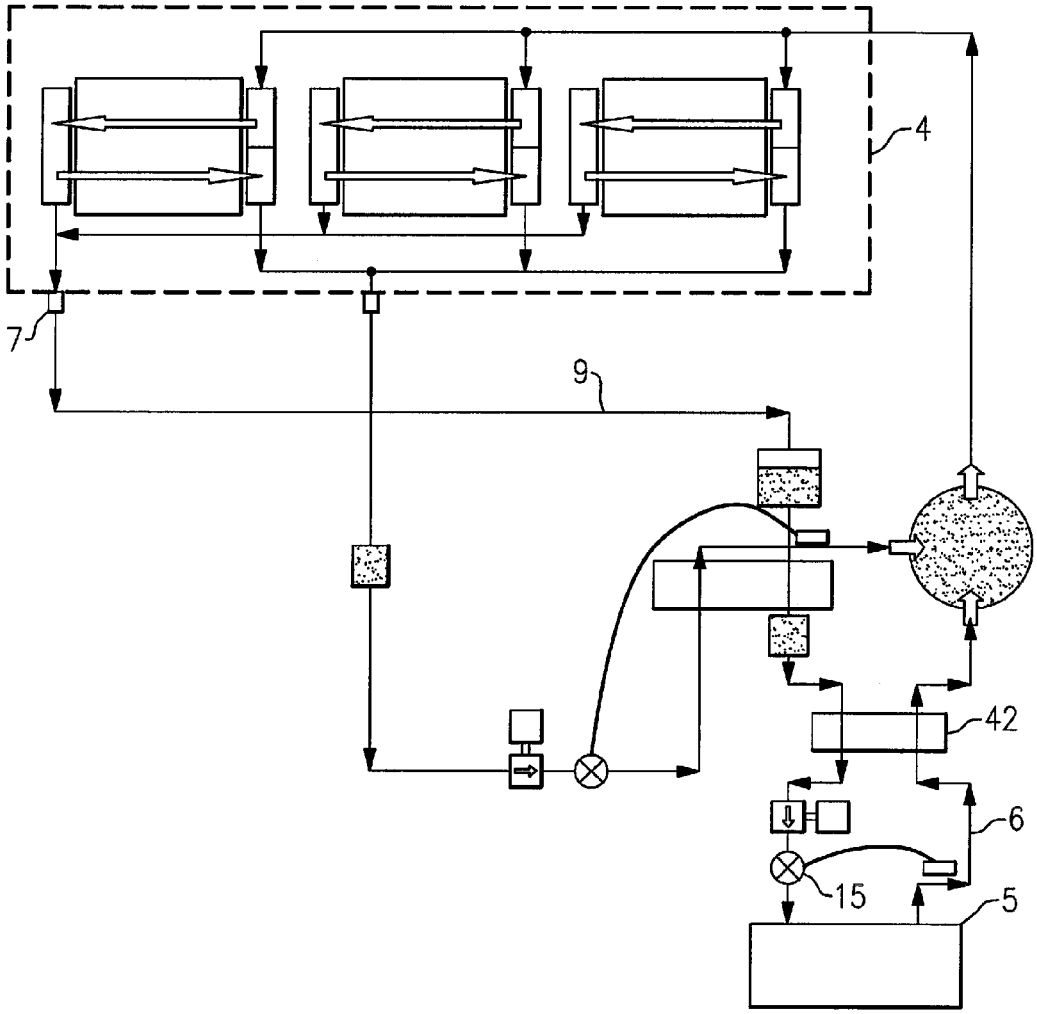
FIG. 11 is a schematic illustration of a refrigerating system with economizing cycle utilizing an economizing heat exchanger, two-stage condensation condenser coils and a liquid-to-suction heat exchanger.

The refrigerating system may have a liquid-to-suction heat exchanger 42 providing thermal contact between liquid refrigerant stream in a main liquid line 9 outgoing from an intermediate liquid outlet 7 of a first stage of a condenser unit 4 and a suction line 6 as shown on FIG. 11. The heat exchanger 42 provides additional sub-cooling of liquid refrigerant at the inlet to an expansion device 15 on account of superheating of vapor leaving the evaporator 5.

Figure 12:
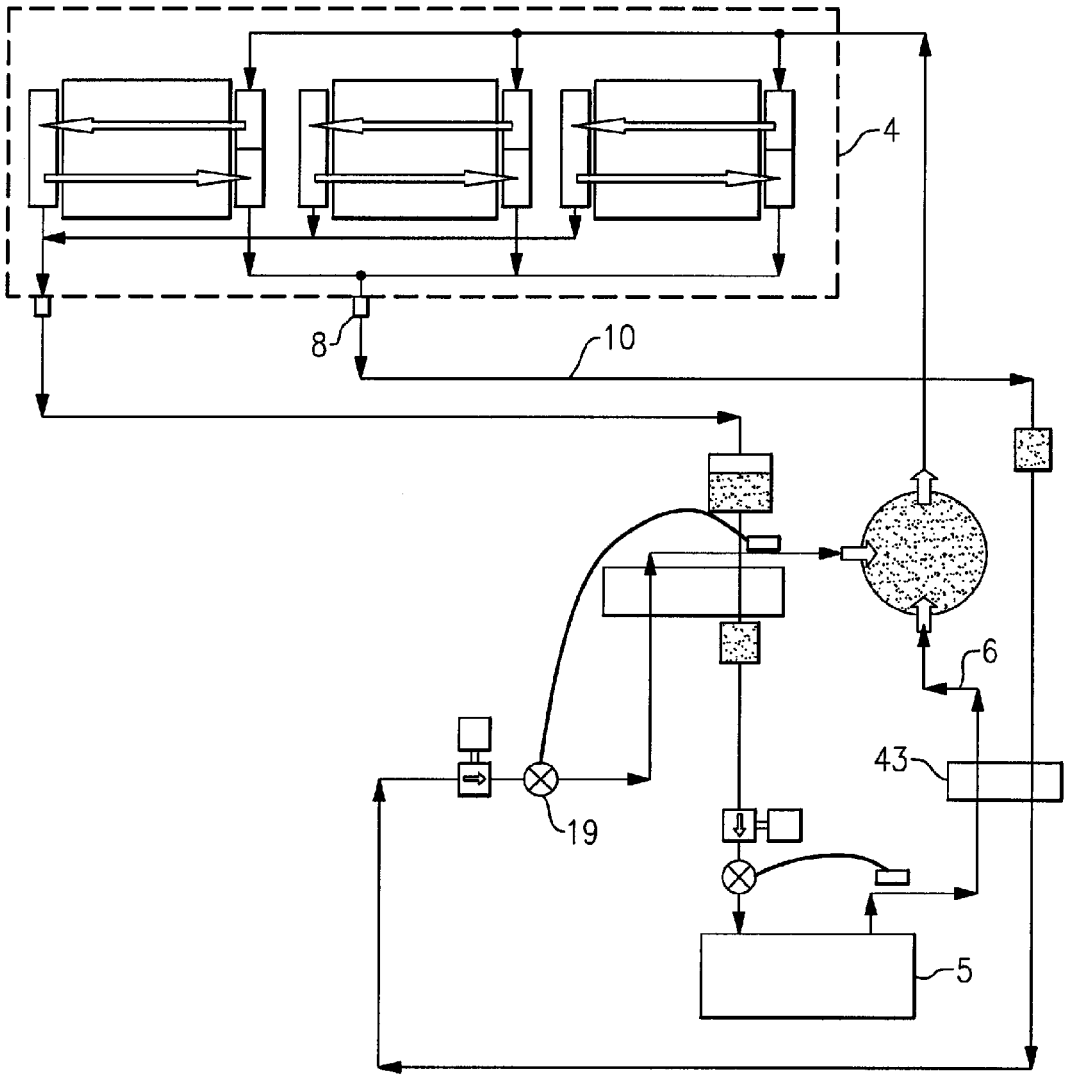
FIG. 12 is a schematic illustration of a refrigerating system with economizing cycle utilizing an economizing heat exchanger, two-stage condensation condenser coils and another liquid-to-suction heat exchanger.

It is more efficient to use a liquid-to-suction heat exchanger 43 providing thermal contact between the liquid refrigerant in an economizing liquid line 10 outgoing from a liquid outlet 8 of a second stage of a condenser unit 4 and a suction line 6 as shown in FIG. 12. The heat exchanger 43 provides sub-cooling of liquid refrigerant at the inlet to an expansion device 19 on account of superheating of vapor leaving an evaporator 5 and has more room for the sub-cooling than the liquid-to-suction heat exchanger 42 in FIG. 11 has.

Figure 13:
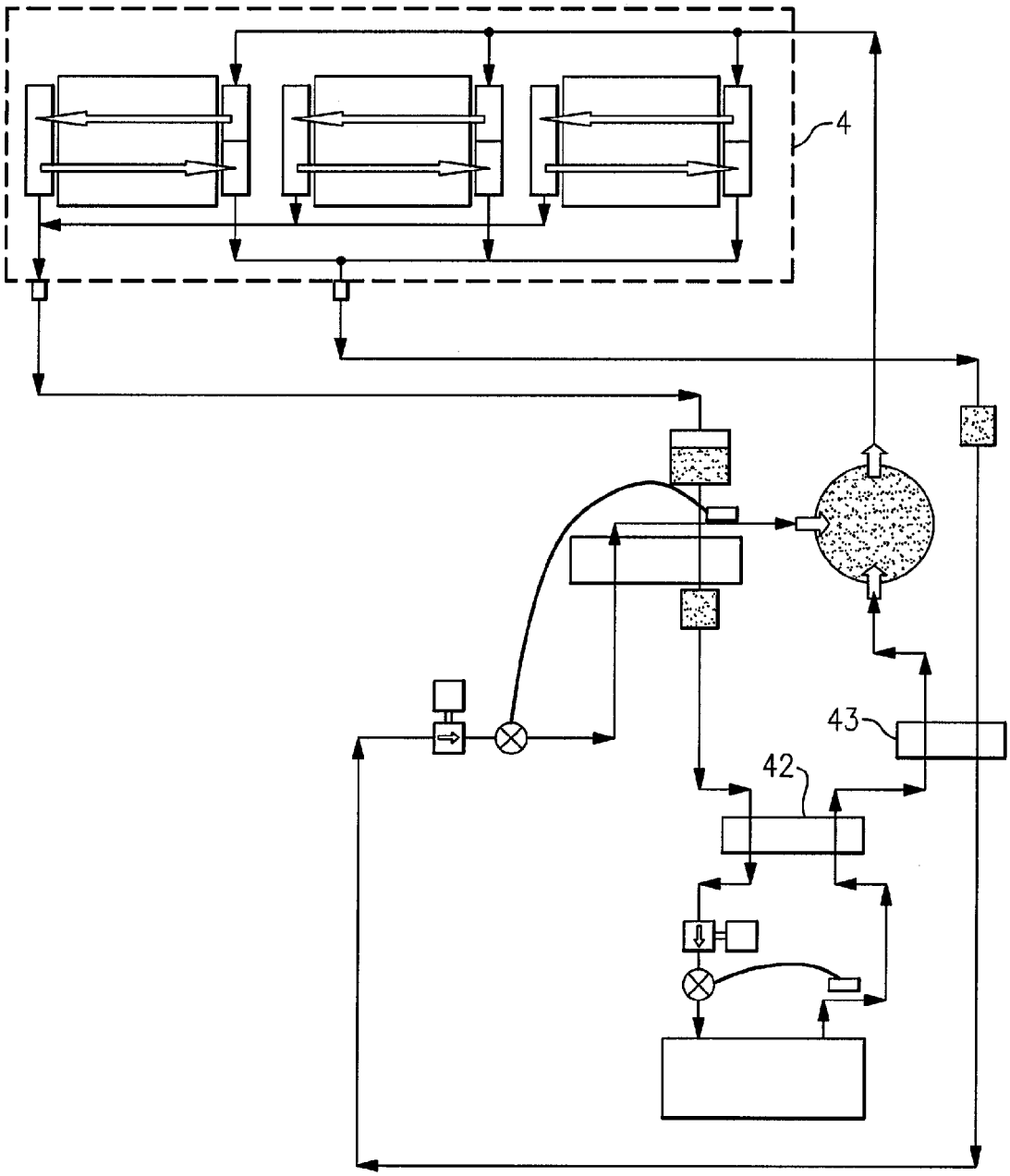
FIG. 13 is a schematic illustration of a refrigerating system with economizing cycle utilizing an economizing heat exchanger, two-stage condensation condenser coils and two liquid-to-suction heat exchangers.

Also, it is possible to employ both liquid-to-suction heat exchangers 42 and 43 as shown in FIG. 13.

Figure 14:
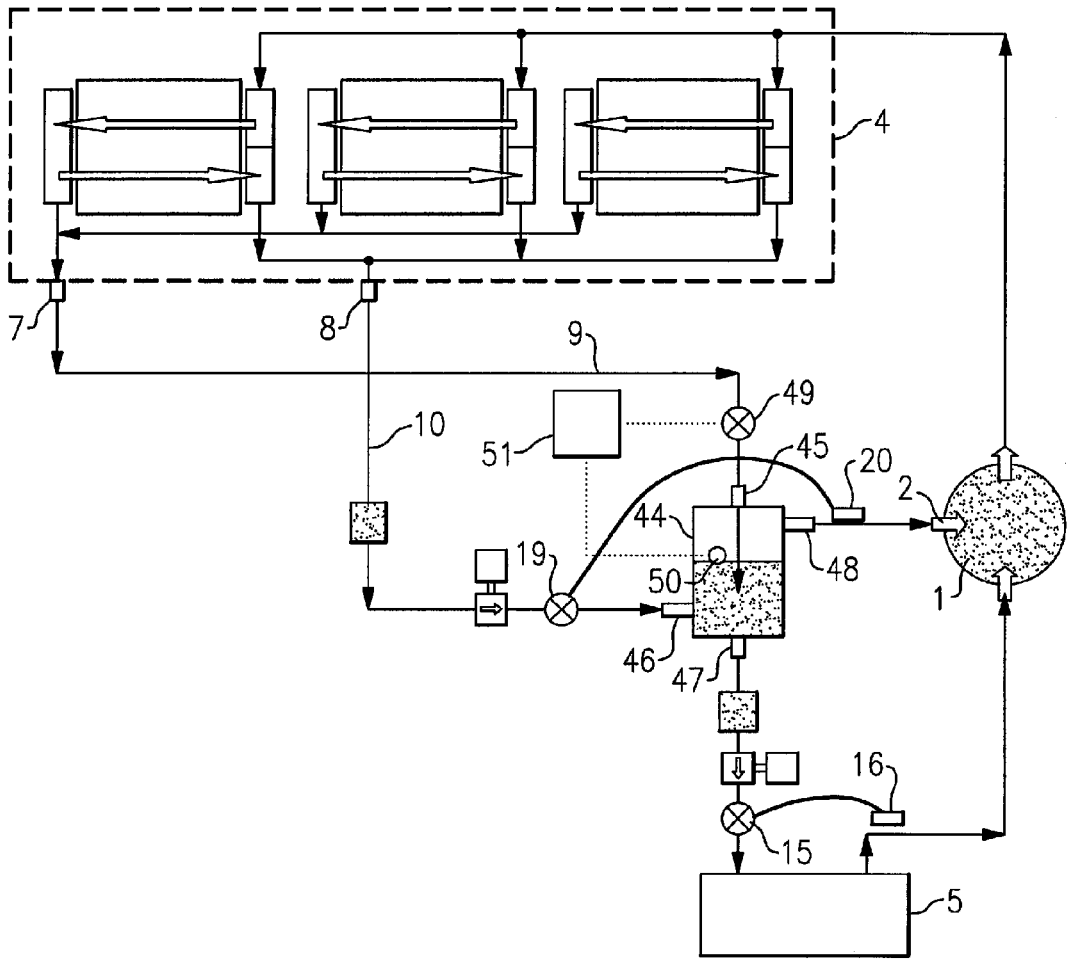
FIG. 14 is a schematic illustration of a refrigerating system with economizing cycle utilizing a flash tank and two-stage condensation condenser coils.
Figure 15:
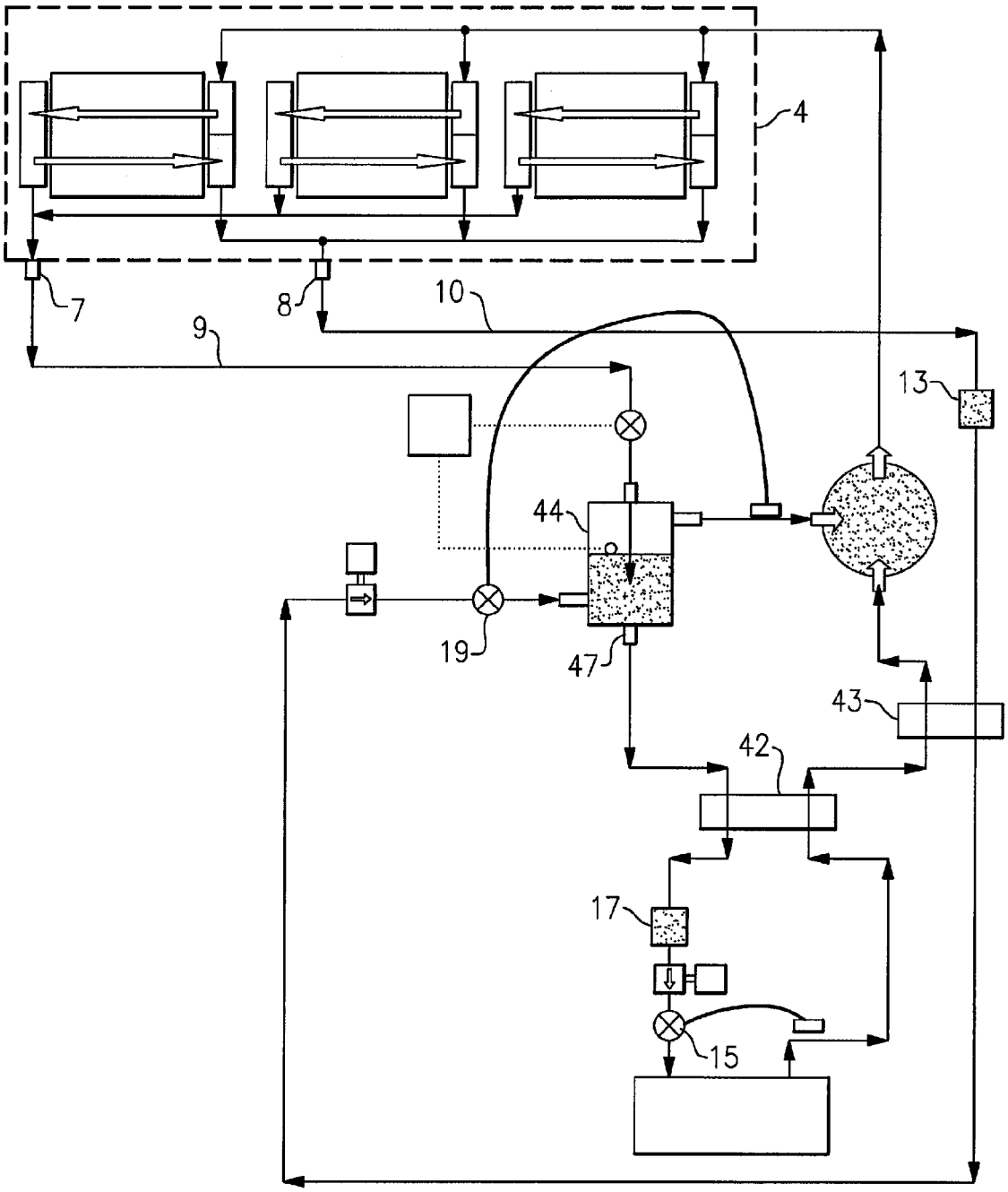
FIG. 15 is a schematic illustration of a refrigerating system with economizing cycle utilizing a flash tank, two-stage condensation condenser coils, and two liquid-to-suction heat exchangers.

FIG. 14 shows a refrigerating system accommodating a flash tank 44. The flash tank 44 has two inlets 45 and 46 and two outlets 47 and 48. An additional expansion device 49 is installed in a main liquid line 9 at the inlet 45 to the flash tank 44. The additional expansion device 49, the inlet 45, the outlet 47 belong to the main liquid line 9 outgoing from an intermediate liquid outlet 7. The inlet 46 and the outlet 48 belong to an economizing liquid line 10 outgoing from an intermediate liquid outlet 8. The mass flow rate through the inlet 45 and the outlet 47 feeds a circuit with an evaporator 5. The mass flow rate through the inlet 46 and the outlet 48 feeds an economizer inlet 2.

The flash tank 44 may have a float 50, which indicates the level of liquid refrigerant in the flash tank 44. Based on a position of the float 50 a control device 51 reduces an opening of the additional expansion device 49 when the level of liquid refrigerant in the flash tank 44 is high and increases the opening of the additional expansion device 49 when the level of liquid refrigerant in the flash tank is low.

Figure 9:
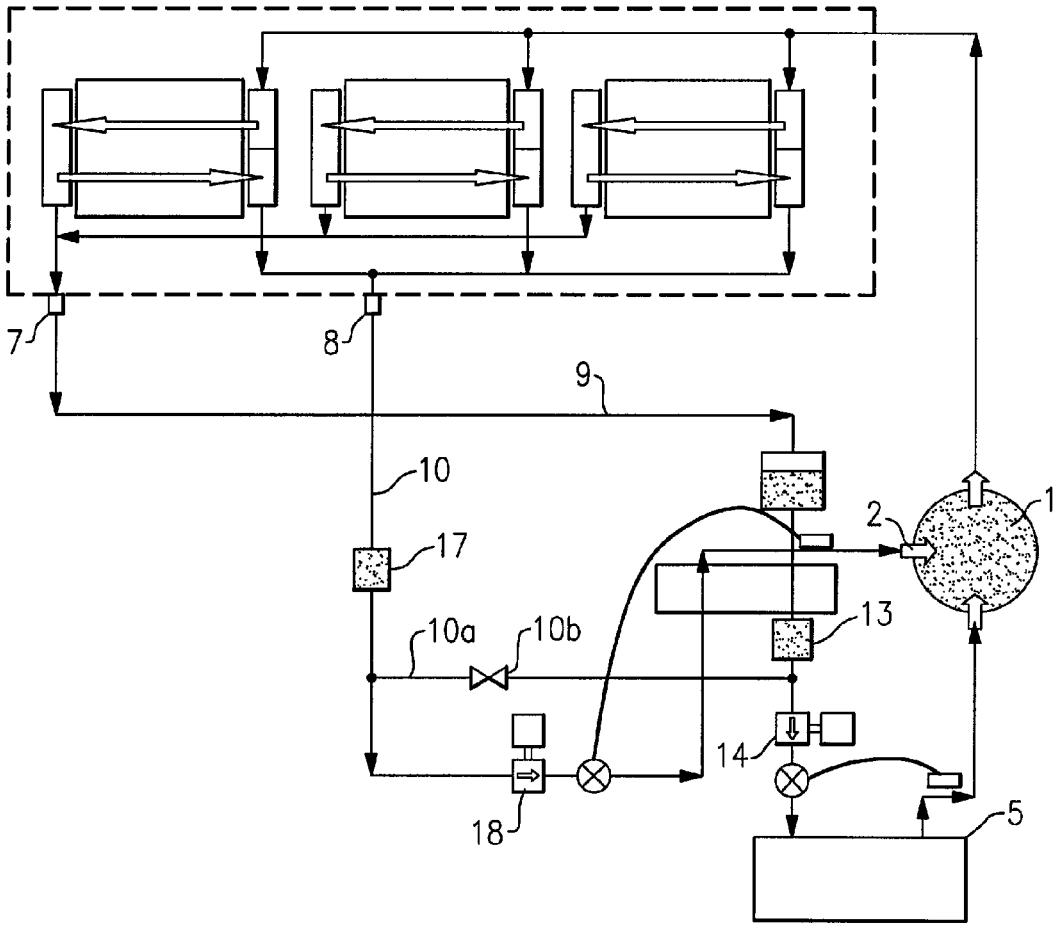
FIG. 9 is a schematic illustration of a refrigerating system with economizing cycle utilizing an economizing heat exchanger, two-stage condensation condenser coils, and a compensation liquid line.

Refrigerating systems accommodating the flash tank 44 may employ the same options as refrigerating systems accommodating economizing heat exchangers: different two-stage condensation condensers as per FIG. 2, FIG. 3, FIG. 4, FIG. 5, FIG. 6, FIG. 7, and FIG. 8; a compensation liquid line as per FIG. 9; a multi-stage compressor as per FIG. 10; and liquid-to-suction heat exchangers as per FIG. 11, FIG. 12, and FIG. 13.

It is important to mention some features related to the use of liquid-to-suction heat exchangers 42 and 43 in refrigerating systems accommodating a flash tank 44 as shown in FIG. 14.

The liquid-to-suction heat exchanger 42 provides thermal contact between liquid refrigerant stream in a main liquid line 9 outgoing from an intermediate liquid outlet 7 of a first condensation stage of a condenser unit 4 and a suction line 6. The liquid-to-suction heat exchanger 42 is installed after a liquid outlet 47 of the flash tank 44 and prior to a filter-drier 17.

The liquid-to-suction heat exchanger 43 provides thermal contact between liquid refrigerant in an economizing liquid line 10 outgoing from an intermediate liquid outlet 8 of a second condensation stage of the condenser unit 4 and the suction line 6.

In accordance with the current invention the refrigerating system accommodating the flash tank 44 may use the liquid-to-suction heat exchanger 42, the liquid-to-suction heat exchanger 43, or both. However, it is important to use the liquid-to-suction heat exchangers 42 at least for the following reason.

The flash tank 44 provides the same liquid temperature at the liquid outlet 47 as the economizing heat exchanger 12 in FIG. 1 at the outlet from the high-pressure side 12*a*; however, the outgoing liquid does not have any sub-cooling. The absence of sub-cooling creates a potential risk for evaporating refrigerant in the filter-drier 17 and at the inlet to a main expansion valve 15 due to pressure drops in the liquid line outgoing from the liquid outlet 47. The liquid-to-suction heat exchanger 42 eliminates this risk.

While certain preferred embodiments of the present invention have been disclosed in detail, it is to be understood that various modifications in its structure may be adopted without departing from the spirit of the invention or the scope of the following claims.

We claim:

1. A refrigerating system comprising:

a main refrigerant loop and an economizing refrigerant circuit;

said main refrigerant loop having an evaporator, a suction line, a compressor unit with an economizer inlet, a condenser unit, a main liquid line, and said economizing refrigerant circuit;

said main liquid line having a liquid receiver, an economizing heat exchanger, and a main expansion device;

said economizing refrigerant circuit having an economizing liquid line with an economizing expansion device and an economizing heat exchanger;

said economizing heat exchanger having a high-pressure side and a low-pressure side; the high-pressure side being associated with said main refrigerant loop and said low-pressure side being associated with said economizing refrigerant circuit;

said condenser unit having a vapor inlet, a plurality of refrigerant channels, an intermediate liquid outlet, a liquid outlet, a first condensation stage associated with part of said refrigerant channels and with said intermediate liquid outlet, a second condensation stage associated with another part of said refrigerant channels and with said liquid outlet;

said main liquid line being adapted for conducting the flow of liquid refrigerant from said first condensation stage to said evaporator;

said economizing liquid line being adapted for conducting the flow of liquid refrigerant from said second condensation stage to said economizer inlet;

said first condensation stage being so sized to provide a liquid mass flow rate required to satisfy a requirement of said evaporator to generate a required capacity and said second condensation stage being so sized as to provide a mass flow rate so as to satisfy a requirement of said economizing line.

2. The refrigerating system as recited in claim 1 wherein said compressor unit is a one-stage compressor.

3. The refrigerating system as recited in claim 1 wherein said compressor unit has at least one compression stage serving as a first compression stage, at least one compression stage serving as a second compression stage, and said economizing inlet is between said first and second compression stages.

4. The refrigerating system as recited in claim 1 wherein a compensation liquid line connects said main liquid line and said economizing line; said compensation line being adapted to compensate for an inequality of liquid mass flow rate provided by said first condensation stage and liquid mass flow rate required to satisfy a requirement of said evaporator and said compensation line being adapted to compensate for an inequality of mass flow rate provided by said second condensation stage to satisfy a requirement of said economizing line when an inequality of mass flow rates occurs.

5. The refrigerating system as recited in claim 4 wherein said compensation liquid line has a valve to disable and enable mass exchange between said main liquid line and said economizing liquid line.

6. The refrigerating system as recited in claim 1 wherein a liquid-to-suction heat exchanger provides thermal contact between liquid refrigerant in said main liquid line and superheated refrigerant leaving said evaporator.

7. The refrigerating system as recited in claim 1 wherein a liquid-to-suction heat exchanger provides thermal contact between liquid refrigerant in said economizing liquid line and superheated refrigerant leaving said evaporator.

8. The refrigerating system as recited in claim 1 wherein a first liquid-to-suction heat exchanger provides thermal contact between liquid refrigerant in said main liquid line and superheated refrigerant leaving said evaporator and a second liquid-to-suction heat exchanger provides thermal contact between liquid refrigerant in said economizing liquid line and superheated refrigerant leaving said first liquid-to-suction heat exchanger.

9. The refrigerating system as recited in claim 1 wherein said main expansion device is an expansion valve with a sensing bulb located at an outlet from said evaporator.

10. The refrigerating system as recited in claim 1 wherein said economizing expansion device is an expansion valve with a sensing bulb located at an outlet from said low-pressure side of said economizing heat exchanger.

11. The refrigerating system as recited in claim 1 wherein a main solenoid valve is installed in said main liquid line.

12. The refrigerating system as recited in claim 1 wherein an economizing solenoid valve is installed in said economizing liquid line.

13. The refrigerating system as recited in claim 1 wherein a main solenoid valve is installed in said main liquid line and an economizing solenoid valve is installed in said economizing liquid line.

14. The refrigerating system as recited in claim 1 wherein a main filter-drier is installed in said main liquid line and an economizing filter-drier is installed in said economizing liquid line.

15. The refrigerating system as recited in claim 1 wherein said condenser unit has a two-stage condensation coil having a vapor inlet, an inlet header, an outlet header, plurality of refrigerant channels extended between said inlet and outlet headers and sealed inside said inlet and outlet headers, an intermediate liquid outlet, a liquid outlet, means to route refrigerant flow from said vapor inlet to said intermediate liquid and liquid outlets, a first condensation stage associated with one part of said refrigerant channels, a second condensation stage associated with another part of said refrigerant channels, and means to remove a condensed liquid portion after said first condensation stage.

16. The refrigerating system as recited in claim 15 wherein said means to route refrigerant flow from said vapor inlet to said intermediate liquid and liquid outlets comprises phase separators, baffles, and a collector inside said inlet header and said outlet header.

17. The refrigerating system as recited in claim 15 wherein said means to remove condensed liquid portion after said first condensation stage comprises phase separators, baffles, and a collector inside said inlet header and said outlet header.

18. The refrigerating system as recited in claim 15 wherein said coil comprise a plurality of coils and a plurality of vapor inlets in said coils are connected to said vapor inlet of said condenser unit, a plurality of intermediate liquid outlets in said coils are connected to said intermediate liquid outlet of said condenser unit, and a plurality of liquid outlets in said coils are connected to said liquid outlet of said condenser unit.

19. The refrigerating system as recited in claim 15 wherein a portion of refrigerant channels associated with said first condensation stage and a portion of refrigerant channels associated with said second condensation stage are oriented horizontally and condensing refrigerant flow is routed from top to bottom.

20. The refrigerating system as recited in claim 15 wherein a portion of refrigerant channels associated with said first condensation stage and a portion of refrigerant channels associated with said second condensation stage are oriented horizontally and condensing refrigerant flow is routed from bottom to top.

21. The refrigerating system as recited in claim 15 wherein part of a portion of refrigerant channels associated with said first condensation stage and said portion of refrigerant channels associated with said second condensation stage are oriented horizontally, a portion of condensing refrigerant flow is routed downwardly, and another portion of condensing refrigerant flow is routed upwardly.

22. The refrigerating system as recited in claim 15 wherein a portion of refrigerant channels associated with said first condensation stage and a portion of refrigerant channels associated with said second condensation stage are oriented vertically, said inlet header is located at a top and said outlet header is located at a bottom.

23. The refrigerating system as recited in claim 15 wherein a portion of refrigerant channels associated with said first condensation stage and a portion of refrigerant channels associated with said second condensation stage are oriented vertically, said inlet header is located at a bottom and said outlet header is located at a top.

24. The refrigerating system as recited in claim 1 wherein said first condensation stage includes at least one whole coil and said second condensation stage includes at least one whole coil.

25. The refrigerating system as recited in claim 1 wherein said first condensation stage includes at least one whole coil and a first condensation stage portion of a two-stage condensation condenser coil; said second condensation stage includes at least one whole coil and remaining portion of said two-stage condensation condenser coil.

26. The refrigerating system as recited in claim 25 wherein said two-stage condensation condenser coil includes a plurality of two-stage condensation condenser coils.

27. A refrigerating system comprising:

a main refrigerant loop and an economizing refrigerant circuit;

said main refrigerant loop including an evaporator, a suction line, a compressor unit with an economizer inlet, a condenser unit, a main liquid line and said economizing refrigerant circuit;

said main liquid line including an additional expansion device, a flash tank, and a main expansion device;

said economizing refrigerant circuit including an economizing liquid line with an economizing expansion device and said flash tank;

said flash tank including an inlet and an outlet associated with said main liquid line, and an inlet and an outlet associated with said economizing refrigerant circuit;

said condenser unit including a vapor inlet, a plurality of refrigerant channels, an intermediate liquid outlet, a liquid outlet, a first condensation stage associated with part of said refrigerant channels and with said intermediate liquid outlet, a second condensation stage associated with another part of said refrigerant channels and with said liquid outlet;

said main liquid line being adapted for conducting the flow of liquid refrigerant stream from said first condensation stage to said evaporator;

said economizing liquid line being adapted to conduct the flow of liquid refrigerant outgoing from said second condensation stage to said economizer inlet;

said first condensation stage being so sized as to provide liquid mass flow rate required to satisfy a requirement of said evaporator to generate a required capacity and said second condensation stage is being so sized as to provide mass flow rate to a satisfy requirement of said economizing line.

28. The refrigerating system as recited in claim 27 wherein said compressor unit comprises a one-stage compressor.

29. The refrigerating system as recited in claim 27, wherein said compressor unit has at least one compression stage serving as a first compression stage, at least one compression stage serving as a second compression stage, and said economizing inlet is between said compression stages.

30. The refrigerating system as recited in claim 27 wherein a compensation liquid line connects said main liquid line and said economizing line; said compensation line being adapted to compensate for an inequality of liquid mass flow rate provided by said first condensation stage and liquid mass flow rate required to satisfy a requirement of said evaporator and said compensation line being adapted to compensate for an inequality of mass flow rate provided by said second condensation stage to satisfy a requirement of said economizing line when an inequality of mass flow rates occurs.

31. The refrigerating system as recited in claim 30 wherein said compensation liquid line includes a valve to disable and enable mass exchange between main said liquid line and said economizing liquid line.

32. The refrigerating system as recited in claim 27 wherein a liquid-to-suction heat exchanger provides thermal contact between liquid refrigerant in said main liquid line and superheated refrigerant leaving said evaporator; said liquid-to-suction heat exchanger is installed at said liquid outlet from said flash tank prior to said main filter-drier.

33. The refrigerating system as recited in claim 27 wherein a liquid-to-suction heat exchanger provides thermal contact between liquid refrigerant in said economizing liquid line and superheated refrigerant leaving said evaporator.

34. The refrigerating system as recited in claim 27 wherein a first liquid-to-suction heat exchanger provides thermal contact between liquid refrigerant in said main liquid line and superheated refrigerant leaving said evaporator and a second liquid-to-suction heat exchanger provides thermal contact between liquid refrigerant in said economizing liquid line and superheated refrigerant leaving said first liquid-to-suction heat exchanger; said first liquid-to-suction heat exchanger is installed at said liquid outlet from said flash tank prior to said main filter-drier.

35. The refrigerating system as recited in claim 27 wherein said main expansion device comprises an expansion valve with a sensing bulb located at outlet from said evaporator.

36. The refrigerating system as recited in claim 27 wherein said economizing expansion device comprises an expansion valve with a sensing bulb located at an outlet from said flash tank in said economizing refrigerant circuit.

37. The refrigerating system as recited in claim 27 wherein a main solenoid valve is installed in said main liquid line.

38. The refrigerating system as recited in claim 27 wherein an economizing solenoid valve is installed in said economizing liquid line.

39. The refrigerating system as recited in claim 27 wherein a main solenoid valve is installed in said main liquid line and an economizing solenoid valve is installed in said economizing liquid line.

40. The refrigerating system as recited in claim 27 wherein a main filter-drier is installed in said main liquid line at an inlet to said main expansion valve and an economizing filter-drier is installed in said economizing liquid line at an inlet to said economizing expansion valve.

41. The refrigerating system as recited in claim 27 wherein said condenser unit includes a two-stage condensation coil having a vapor inlet, an inlet header, an outlet header, a plurality of refrigerant channels extending between said inlet and outlet headers and sealed inside said inlet and outlet headers, an intermediate liquid outlet, a liquid outlet, means to route refrigerant flow from said vapor inlet to said intermediate liquid and liquid outlets, a first condensation stage associated with one part of said refrigerant channels, a second condensation stage associated with another part of said refrigerant channels, and means to remove condensed liquid portion after said first condensation stage.

42. The refrigerating system as recited in claim 41 wherein said means to route refrigerant flow from said vapor inlet to said intermediate liquid and liquid outlets comprises phase separators, baffles, and a collector inside said inlet header and said outlet header.

43. The refrigerating system as recited in claim 41 wherein said means to remove condensed liquid portion after said first condensation stage comprises phase separators, baffles, and a collector inside said inlet header and said outlet header.

44. The refrigerating system as recited in claim 41 wherein said coil comprises a plurality of coils and a plurality of vapor inlets of said coils are connected to said vapor inlet of said condenser unit, a plurality of intermediate liquid outlets of said coils are connected to said intermediate liquid outlet of said condenser unit, and plurality of liquid outlets of said coils are connected to said liquid outlet of said condenser unit.

45. The refrigerating system as recited in claim 41 wherein a portion of refrigerant channels associated with said first condensation stage and another portion of refrigerant channels associated with said second condensation stage are oriented horizontally and condensing refrigerant flow is routed from top to bottom.

46. The refrigerating system as recited in claim 41 wherein a portion of refrigerant channels associated with said first condensation stage and another portion of refrigerant channels associated with said second condensation stage are oriented horizontally and condensing refrigerant flow is routed from bottom to top.

47. The refrigerating system as recited in claim 41 wherein part of a portion of refrigerant channels associated with said first condensation stage and another portion of refrigerant channels associated with said second condensation stage are oriented horizontally, a portion of condensing refrigerant flow is routed downwards, and other portion of condensing refrigerant flow is routed upwards.

48. The refrigerating system as recited in claim 41 wherein a portion of refrigerant channels associated with said first condensation stage and another portion of refrigerant channels associated with said second condensation stage are oriented vertically, said inlet header is located at top and said outlet header is located at bottom.

49. The refrigerating system as recited in claim 41 wherein a portion of refrigerant channels associated with said first condensation stage and another portion of refrigerant channels associated with said second condensation stage are oriented vertically, said inlet header is located at a bottom and said outlet header is located at a top.

50. The refrigerating system as recited in claim 27 wherein said first condensation stage includes at least one whole coil and said second condensation stage includes at least one whole coil.

51. The refrigerating system as recited in claim 27 wherein said first condensation stage includes at least one whole coil and a first condensation stage portion of a two-stage condensation condenser coil; said second condensation stage includes at least one whole coil and the remaining portion of said two-stage condensation condenser coil.

52. The refrigerating system as recited in claim 51 wherein said two-stage condensation condenser coil comprises a plurality of two-stage condensation condenser coils.

53. The refrigerating system as recited in claim 27 wherein said flash tank includes a float indicating level of liquid refrigerant in said flash tank.

54. The refrigerating system as recited in claim 53 wherein, based on a position of said float, a control device reduces an opening of said additional expansion device when a level of liquid refrigerant in said flash tank is high and increases opening of said additional expansion device when a level of liquid refrigerant in said flash tank is low.

55. A refrigerating system comprising:

a main refrigerant loop and an economizing refrigerant circuit;

said main refrigerant loop having an evaporator, a suction line, a compressor unit with an economizer inlet, a condenser unit, a main liquid line, and said economizing refrigerant circuit;

said economizing refrigerant circuit having an economizing liquid line;

said condenser unit having a vapor inlet, a plurality of refrigerant channels, an intermediate liquid outlet, a liquid outlet, a first condensation stage associated with part of said refrigerant channels and with said intermediate liquid outlet, a second condensation stage associated with another part of said refrigerant channels and with said liquid outlet;

said main liquid line being adapted for conducting the flow of liquid refrigerant from said first condensation stage to said evaporator;

said economizing liquid line being adapted for conducting the flow of liquid refrigerant from said second condensation stage to said economizer inlet; and said first condensation stage being so sized as to provide a liquid mass flow rate required to satisfy a requirement of said evaporator to generate a required capacity and said second condensation stage being so sized as to provide a liquid mass flow rate so as to satisfy a requirement of said economizing line.

* * * * *